United States Patent [19]

Julian Lecha

[11] 4,011,812

[45] Mar. 15, 1977

[54] MACHINE FOR PRINTING DIFFERENT COLORS SIMULTANEOUSLY BY THE OFFSET METHOD

[76] Inventor: Manuel Julian Lecha, Mallorca 49, Barcelona, Spain

[22] Filed: May 31, 1974

[21] Appl. No.: 475,246

Related U.S. Application Data

[63] Continuation of Ser. No. 301,247, Oct. 26, 1972, abandoned.

[52] U.S. Cl. ..... 101/176; 101/177

[51] Int. Cl.[2] ..... B41F 5/16

[58] Field of Search ..... 101/174–177, 101/217–218, 136–140, 141–145

[56] References Cited

UNITED STATES PATENTS

| | | | |
|---|---|---|---|
| 1,025,257 | 5/1912 | Firm | 101/175 X |
| 1,025,258 | 5/1912 | Firm | 101/175 |
| 2,884,855 | 5/1959 | Koch | 101/142 |
| 3,536,006 | 10/1970 | Roozee | 101/137 |

*Primary Examiner*—J. Reed Fisher
*Attorney, Agent, or Firm*—Wenderoth, Lind & Ponack

[57] ABSTRACT

A new machine for printing different colors simultaneously by the offset method, includes a single sectored cylinder which acts upon a single rubber printing cylinder and which bears several sectors mounted upon its surface. The sectors are fixed to it by conventional centering and adjusting means, the machine being at the same time provided with individual fountains and rollers for ink and water, one for each of the sectors. Each of the sectors is a receiver of a single color. The fountains and rollers of ink and water are provided with retractable means, in such a manner that each of the fountain and roller arrangements dedicated to a given color operates at a determined time on one and only one sector, the sector involved corresponding to the given color.

3 Claims, 2 Drawing Figures

MACHINE FOR PRINTING DIFFERENT COLORS SIMULTANEOUSLY BY THE OFFSET METHOD

This is a continuation of application Ser. No. 301,247, now abandoned, filed Oct. 26, 1972.

BACKGROUND OF THE INVENTION

It is well known that two systems for printing in color are used: one a rotary system with a continuous roll of paper and another for flat printing on cut sheets of paper.

Both of these systems have their advantages and disadvantages. The first system, i.e. the system which uses a rotating machine, is more rapid than the other, but on the other hand is less accurate.

SUMMARY OF THE INVENTION

The object of the present invention is to provide a new machine for printing several colors simultaneously by the offset method. This machine combines the more outstanding qualities of the two systems now in use, i.e. the speed of the one and the accuracy of registration of the other.

Differing from the prior art, the present machine includes a single sectored plate cylinder in conjunction with a set of rubber printing cylinders, only one of which prints at a given time. The sectored plate cylinder has fixed to it by conventional means several sectors, in the form of raised arcs of uniform surface radius. The means for fixing the sectors include centering and adjusting elements for positioning the sectors at the optimum desired position.

Each of the sectors on the plate cylinder has an individual arrangement of fountains and rollers for ink and water. Each such arrangement operates in conjunction with only one sector and with only a single color.

The before-mentioned fountains and rollers of water and ink are disposed with retractable means in such a manner that each of the arrangements enters into service at a predetermined period of time, which coincides with the passage thereby of the specific sector corresponding to the color of each arrangement. Each arrangement transfers to its respective sector the corresponding layer of ink and water and then withdraws from such sector by means of its retractable means to a position at rest, a position maintained during the passage of the other sectors during one revolution of the sectored plate cylinder.

As aforesaid, each sector of the sectored plate cylinder operates on each rubber printing cylinder, depositing and superposing consecutively on the surface of each printing cylinder the colors from each of the sectors in such a manner that one revolution of the rubber cylinder against the surface to be printed deposits thereon all of the colors.

Each rubber cylinder which receives the impressions of the sectors is mounted together with other similar cylinders upon a common rotating support. This permits a continuous printing process.

The common support remains motionless upon its axis when a given rubber cylinder is in a tangential position with respect to the sectored cylinder and remains motionless while the rubber cylinder, spinning upon its own axis disposed in the common support, receives upon its surface the successive and continuous impressions transmitted by each and every one of the sectors carried by the sectored cylinder. Thereupon, the common support spins a fraction of a turn until a second rubber cylinder is located tangentially against the sectored cylinder, etc.

This fraction of a turn is a function of the number of rubber cylinders supported by the common support. During each stopping period of the common support, one rubber cylinder receives the impression from the sectored cylinder. Meanwhile, the diametrically opposite rubber cylinder deposits its impression upon the receiving surface, and the remaining rubber cylinders receive any necessary treatment before and after the impression.

Each of the rubber cylinders are individually positioned on the common support and are provided with individual rotating means. The circumferential rotational speed of the rubber cylinder in contact with the plate cylinder is the same as the rotational speed of the plate cylinder. However, due to the plurality of rubber cylinders, the speed of the rubber cylinder in contact with the surface to be printed may be much lower, i.e. specifically 1/X the rotational speed of the rubber cylinder in contact with the plate cylinder, wherein X is the number of sectors.

All of the rubber cylinders may be served by various auxiliary elements of the machine. Some of these auxiliary elements are located about the sectored cylinder, with its fountains and rollers, while others include the support of the surface to be printed, a dryer, whose purpose is to evaporate the water that impregnates, along with the ink, the peripheries of the rubber cylinders, and furthermore a cleaning device which prepares the surface of the rubber cylinder about to receive the impression of a sector, as well as other devices disposed about the rubber cylinders for the specific purpose of providing treatment before or after the disposition of the ink, such as, for example, a lacquering of the surface of the cylinder.

The operation of the dryer is carried out individually and in turn upon each one of the rubber cylinders immediately after the superposed layers of ink have been deposited upon such cylinder and before this ink impression has been transferred to the receiving surface.

A pressure cylinder is situated conventionally beneath the surface to be printed and presses against this surface and the rubber cylinder beyond, during the time that the impression is to be produced.

Logically, the mechanisms which permit the retractable movements of the ink and water fountain and roller arrangements as they serve each one of the sectors, and the driving elements and power transmission devices which move each one of the elements comprising the machine and the rest of the complementary elements not mentioned, are all of conventional design, and do not constitute the inventive concept of the machine of the invention, and have not been described or illustrated in the following description.

The novelty of the machine of the invention lies in the fact that it consists of a single sectored cylinder, that this sectored cylinder bears several sectors, each one for a different color, and that these different sectors operate upon only one single rubber cylinder, of a plurality of said cylinders, at a time, such rubber cylinder receiving each of the different colors superposed, and that this rubber roller subsequently prints during one revolution about its own axis all the colors on the surface to be printed.

The invention will be described in more detail in the following description taken together with the accompanying drawings.

DETAILED DESCRIPTION OF THE INVENTION

Figure 1:
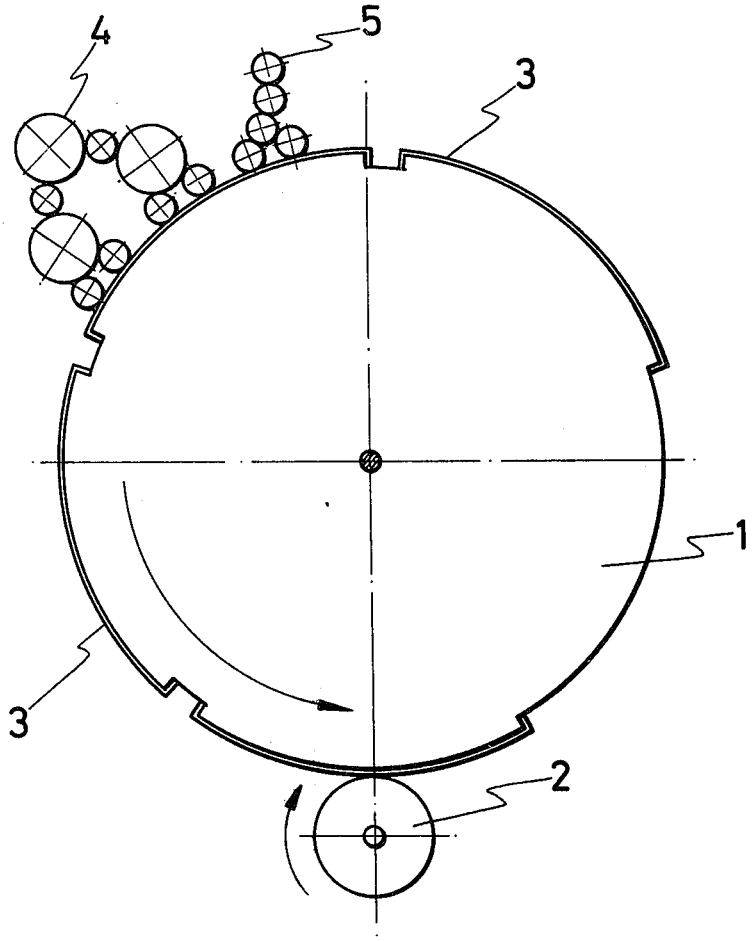
FIG. 1 is a side diagrammatic view of a portion of a machine illustrating the basic concept of the present invention.

It is to be understood that the invention is applicable to any type of offset printing machine whether it be of three-color, four-color process or whatsoever, as well as silver or gold printing by means of independent rollers. Referring to FIG. 1, there is shown a sectored plate cylinder 1, a rubber roller 2, sectors 3 arranged about the periphery of the plate cylinder, fountains and rollers 4 for ink, and fountains and rollers 5 for water.

On the surface of the plate cylinder is an empty space equal to that occupied by a sector, such empty space being used as the location for the positioning of fastening and adjusting means. Such empty space permits continuous rotation of the sectored cylinder and conjointly the operation of the rubber cylinder, thus depositing upon the receiving surface the totality of the impression within a single revolution. This illustrates how a machine in accordance with the invention may include only a single rubber cylinder in combination with the sectored plate cylinder.

Figure 2:
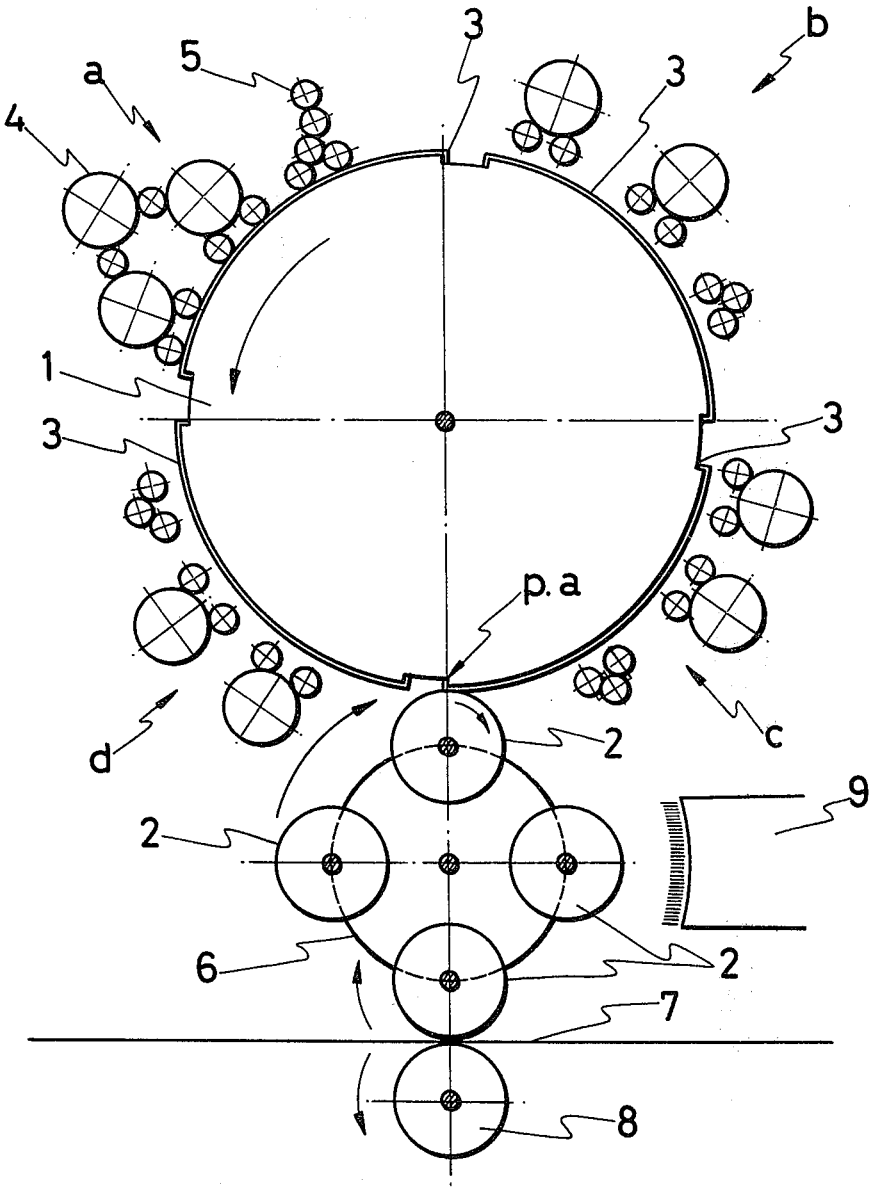
FIG. 2 is a side diagrammatic view of a machine illustrating a specific embodiment of the present invention.

Referring to FIG. 2 of the drawings, there is shown the sectored plate cylinder 1, the rubber cylinders 2, the sectors 3, the ink rollers 4, the water rollers 5, a rotating support 6 for the rubber rollers, the surface 7 to be printed, the pressure roller 8, and the dryer 9. The elements are driven such that tangential pressure point (pa) for each one of the sectors 3 coincides exactly and successively upon an identical point on the rubber cylinder 2.

It is obvious that the machine of the invention utilizes a continuous surface for the impression (in the case of paper, a continuous strip), the main advantage of the rotary machine, and also has the main advantage of a flat press which uses cut sheets.

The machine of the present invention contains the basic advantage of the flat press, i.e. registration accuracy obtained during printing. For anyone versed in the art, the fact is well known that a rotary machine offers inaccuracies in the registration as a consequence of the passage of the surface receiving the impression (such as paper) through different printing elements, the surface being contacted by such elements successively, and further due to the mechanical forces to which the paper is submitted throughout the series of impressions, due to the use of water, all of which alter the physical characteristics of the paper and produce irregularities.

A principle advantage of the present invention is that since the successive impressions of ink and water, one for each color, are received directly from the sectors by a rubber cylinder, a single rubber cylinder receives on its surface the same impression as is to appear subsequently on the paper or other receiving surfaces, and the transference of the impression from the rubber cylinder to the paper is all accomplished at one time.

The proposed machine utilizes clamps merely for advancing the paper, and the registration of the paper does not exist in a mechanical sense, since it is developed on the rubber cylinder instead. A very important result of the present invention is that the speed of the new machine may exceed the speed of the conventional rotary machine, since the proposed machine, when used with a continuous strip of paper, does not necessarily depend on clamps for advancing the paper, and its speed is limited solely by the tensile strength of the paper, or by the spinning rate of the cylinders. The new machine is able to accept sheets at the same rate as if a continuous paper strip were concerned.

I claim:

1. A machine for printing a plurality of colors by the offset method, said machine comprising:

a single sectored plate cylinder, means to mount said single sectored plate cylinder to rotate at a predetermined circumferential speed, said plate cylinder having equally spaced around the periphery thereof a plurality of equal length zones, each of said zones having fixed thereto an ink receiving sector, each of said sectors having associated therewith separate individual arrangements of ink and water fountains and rollers for a separate of said plurality of colors, means for moving each of said fountain and roller arrangements into contact with only a predetermined one of said sectors to apply thereto the separate color thereof;

a plurality of rubber printing cylinders, the circumferential length of each of said printing cylinders being equal to the length of each of said sectors of said plate cylinder;

a rotatable support mounting at equal angles around the periphery thereof said plurality of printing cylinders, means for incrementally rotating said support to sequentially bring each of said printing cylinders to a first position to be in contact with said sectors of said plate cylinder and thereafter to a second position to be in contact with a surface to be printed; and means to rotate each of said printing cylinders at a first circumferential speed in said first position and at a second circumferential speed in said second position.

2. A machine as claimed in claim 1, wherein said first circumferential speed of each of said printing cylinders equals said predetermined circumferential speed of said plate cylinder.

3. A machine as claimed in claim 2, wherein said second circumferential speed of each of said printing cylinders is 1/X of said first circumferential speed thereof, wherein X equals the number of said plurality of sectors.

* * * * *